US006823926B1

(12) United States Patent
Tyner

(10) Patent No.: US 6,823,926 B1
(45) Date of Patent: Nov. 30, 2004

(54) CORD LOCK

(75) Inventor: James D. Tyner, Clermont, FL (US)

(73) Assignee: ITA, Inc., St. Augustine, FL (US)

( * ) Notice: Subject to any disclaimer, the term of this patent is extended or adjusted under 35 U.S.C. 154(b) by 0 days.

(21) Appl. No.: 10/438,699

(22) Filed: May 15, 2003

(51) Int. Cl.[7] ..... E06B 9/324

(52) U.S. Cl. ..... 160/178.2; 160/168.1; 160/173

(58) Field of Search ..... 160/178.2, 168.1, 160/173; 24/461, 462

(56) References Cited

U.S. PATENT DOCUMENTS

| | | | | |
|---|---|---|---|---|
| 450,392 | A | | 4/1891 | Wilson |
| 2,091,033 | A | | 8/1937 | Dodge |
| 2,223,403 | A | | 12/1940 | Burnsq |
| 2,494,759 | A | | 1/1950 | Hirschy |
| 3,221,802 | A | * | 12/1965 | Hurkmans ..... 160/173 R |
| D247,020 | S | | 1/1978 | Glumac |
| 4,250,597 | A | * | 2/1981 | Ford et al. ..... 24/132 R |
| 4,352,386 | A | | 10/1982 | Butler et al. |
| 4,413,664 | A | * | 11/1983 | Istha ..... 160/178.2 |
| 4,463,791 | A | | 8/1984 | McClure |
| 4,488,588 | A | | 12/1984 | McClure |
| 4,667,723 | A | | 5/1987 | Spangenberg |
| 4,945,970 | A | * | 8/1990 | Marocco ..... 160/178.2 |
| 4,947,921 | A | | 8/1990 | Chun-cheng |
| 5,316,066 | A | | 5/1994 | Rapp et al. |
| 6,050,321 | A | * | 4/2000 | Koks et al. ..... 160/178.2 |
| D429,588 | S | | 8/2000 | Smederod |
| 6,148,894 | A | | 11/2000 | Judkins |
| 2003/0173037 | A1 | * | 9/2003 | Liu ..... 160/178.2 |

* cited by examiner

*Primary Examiner*—Bruce A. Lev
(74) *Attorney, Agent, or Firm*—Buchanan Ingersoll PC

(57) ABSTRACT

A cord lock for a venetian type blind or pleated shade has a flange extending from each of the front wall and the rear wall of the cord lock housing. The cord lock fits into a pocket in the headrail. A tab on the upper edge of the pocket is received by a slot in one of the flanges. The cord lock fits into the pocket in only one orientation and can be easily removed from one pocket and placed in the other pocket by an installer.

16 Claims, 2 Drawing Sheets

CORD LOCK

FIELD OF INVENTION

The invention relates to a cord lock placed in a headrail for venetian type blinds or pleated shades in which lift cords pass through a cord lock at one end of the headrail.

BACKGROUND OF THE INVENTION

Venetian type blinds, pleated shades, roman shades and roll-up blinds have lift cords for raising and lowering the window covering material. The lift cords extend from a bottomrail through or past the window covering material and into the headrail. The cords can be collected on a cord collector within the headrail or, more typically, exit one end of the headrail. In most of these blinds a cord lock is provided at one end of the headrail and the lift cords pass through that cord lock as they exit the headrail. The cord lock allows the user to maintain the blind in any desired position from fully raised to fully lowered.

Most headrails for window coverings operated by lift cords are U-shaped channels. An opening is cut in the bottom or front of the channel through which the lift cords exit the headrail. Usually, the cord lock is attached to the headrail so that the cord lock is within or extends over the opening. The cord lock may be held in place by clips or tabs that attach to the opening. An example of such a cord lock is disclosed in U.S. Pat. No. 4,947,921 to Chun-cheng. Other cord locks extend the full height of the handrail and snap under the rolled top edges of the headrail. McClure discloses such a cord lock in U.S. Pat. No. 4,488,588. Still other cord locks have flanges that are fastened to the headrail by screws or rivets. The cord lock disclosed in U.S. Pat. No. 2,091,033 to Dodge is attached to the headrail in this manner. Yet, another type of cord lock is fastened to a cradle or bracket plate within the headrail. Bums discloses this type of cord locking mechanism in U.S. Pat. No. 2,223,403. All of these cord locks have a significant disadvantage in that once in place they are relatively difficult to remove.

Nearly all blinds and pleated shades are fabricated in a factory and taken in finished form to the house or building where they will be hung by an installer. The installer mounts the brackets that hold the blind at each window location and may adjust the length of the blind at the time of installation. The salesman should ask the buyer if he or she has a preference as to whether the lift cords and tilt cords should be on the right side or the left side of the blind. If there is a preference, the factory ought to be notified so that the blind is fabricated according to the customer's preference. Should the installer deliver a conventional blind with the controls on the wrong side, he cannot change the location of the blind controls in the field and must return that blind to the factory. Although some installers have the skills and the tools to fabricate blinds in their shop they seldom reconfigure blinds in their shop to change the position of the controls because that is a time consuming process. It is easier and less costly for the installer to simply return the blind to the factory. Each return means that the installer must make a second trip to the home or business thereby increasing the cost of the sale to both the manufacturer and the installer. Furthermore, if an installer is required to return to a home to replace a blind, very often the customer will ask the installer to make other changes or adjustments. Then the installer must spend even more time on that sale. Consequently, there is a need for a headrail for venetian blinds and pleated shades in which the installer can change the position of the cord lock from one end of the headrail to the opposite end of the headrail in the field where the window covering is being installed.

In U.S. Pat. No. 6,148,894 Judkins discloses a headrail having reversible modular controls allowing the cord lock to be positioned at either end of the headrail. The headrail has two sidewalls that are spaced apart, generally parallel and attached to the base. Each sidewall has a slot sized to receive a plug or a fitting through which the lift cords and tilt cords or a hook for a tilt wand pass. The slots are opposite one another and of a same size. One changes the controls from one end of the headrail to the opposite end of the headrail by moving the lift cords and tilt cord or hook from one slot to the other slot. This requires that slots be cut in the sidewalls and a plug be provided for one of the slots.

Consequently, there is a need for a headrail in which the installer can change the position of the cord lock from one end of the headrail to an opposite end at the time the headrail is installed. That need can best be fulfilled if there is a cord lock that can easily be removed from and replaced into the headrail.

SUMMARY OF THE INVENTION

I provide a cord lock and headrail for venetian type blinds and pleated shades in which the cord lock can be easily switched from the right side of the blind to the left side of the blind or vice versa. The headrail has an elongated body having a base, a first sidewall and a second sidewall. I provide an insert or endcap that fits into the end of the headrail and is carried by a slot or rib on each of the sidewalls. A pair of pockets are provided on the insert, the pockets being positioned so that one pocket is adjacent each sidewall when the insert is attached to the end of a headrail. The pockets are generally rectangular and have a front wall and a rear wall that are generally parallel. A tab extends from the top edge of the front wall The cord lock has a rectangular housing and fits within the pocket. A flange extends from the front side of the cord lock housing and rests on the top edge of the front wall of the pocket. A second flange extends from the rear wall of the cord lock housing and rests on the top edge of the rear wall of the pocket. There is no slot in the second flange that is similar in size and location to the slot in the first flange. The cord lock can be dropped into the pocket. But, it will only fit properly when the first flange rests on the top edge of the front wall of the pocket and the tab is within the slot. This cord lock can be easily lifted from the pocket without using any tools.

Other objects and advantages of the present invention will become apparent from a description of the present preferred embodiments shown in the drawings.

DESCRIPTION OF THE PREFERRED EMBODIMENTS

Figure 1:
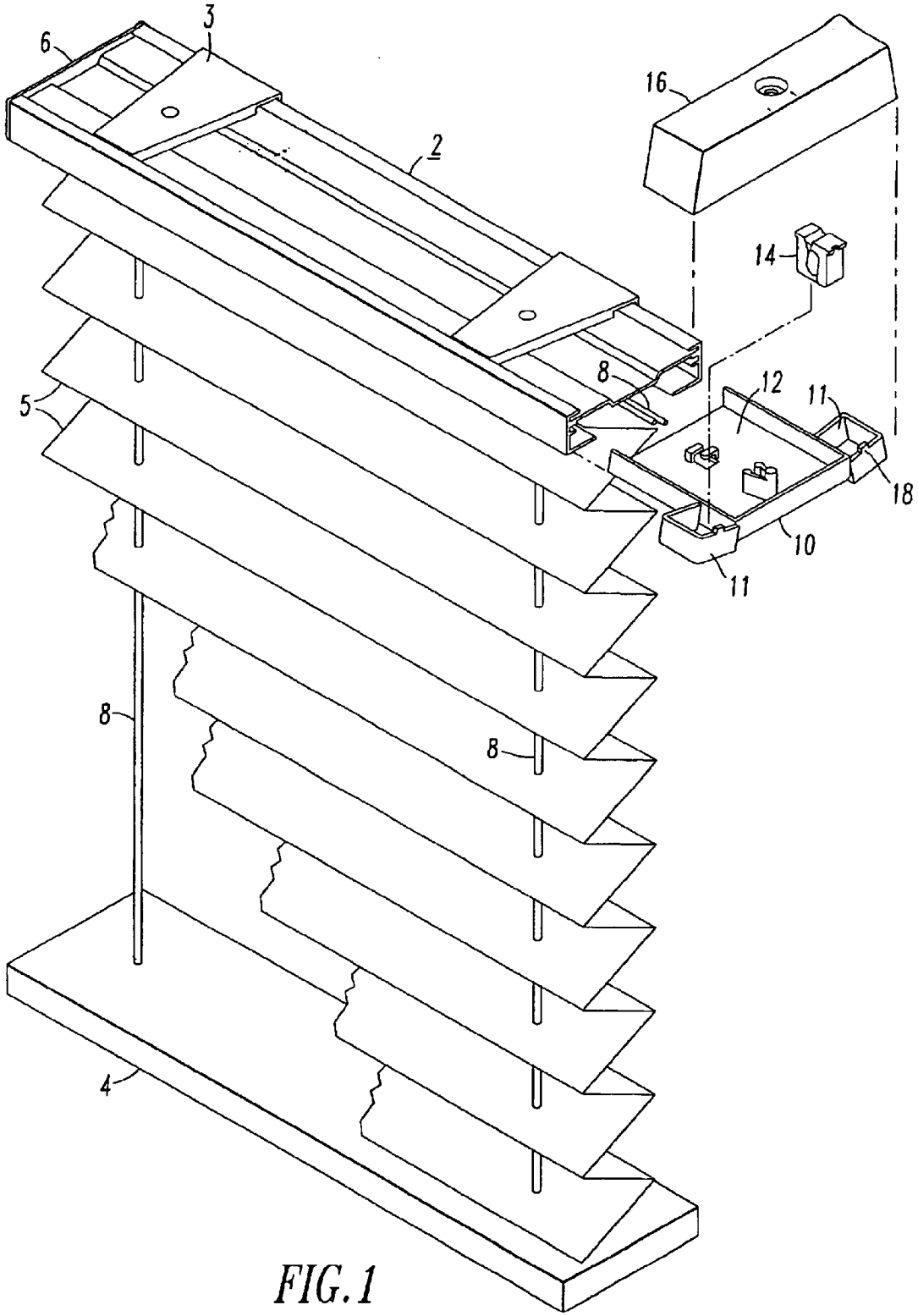
FIG. 1 is an exploded view of a pleated shade having a present preferred cord lock and headrail made in accordance with the present invention.

As shown in FIG. 1 a present preferred window covering contains a headrail 2, a bottom rail 4 and a pleated window covering material 5 extending therebetween. Although the embodiment shown in FIG. 1 is a pleated shade, the present invention can be used with any window covering that contains a headrail and lift cords including cellular shades, roman shades and venetian blinds. End cap 6 is attached to one end of the headrail 2. Lift cords 8 pass from the bottomrail 4 into and through the headrail 2. The lift cords 8 may pass through holes in the window covering material 5 or be routed behind the window covering material. Within the headrail the lift cords 8 run to a cord lock 14. They pass through the cord lock 14 and are of a length that an operator of the blind can easily reach the end of the lift cords. The number of lift cords that are used will vary according to the size of the blind and the cording arrangement. The cord lock 14 is carried in a pocket 11 on an insert 10 that fits into either end of the headrail 2. The insert has two pockets 11 on opposite sides of the body 12 of the insert 10. Insert 10 is pushed into the headrail until the pockets 11 abut the end of the headrail. Then a cover 16 is placed over the pockets. Insert 10 and end cap 6 can be placed in either end of the headrail 2. The assembly of elongated body or headrail 2, insert 10, cord lock 14, end cap 6 and cover 16 may also be called the headrail of the window covering by those skilled in the art. The headrail 2 shown in FIG. 1 is preferred. However, other configurations could be used. Mounting brackets 3 are provided to attach the blind to a window frame.

Figure 2:
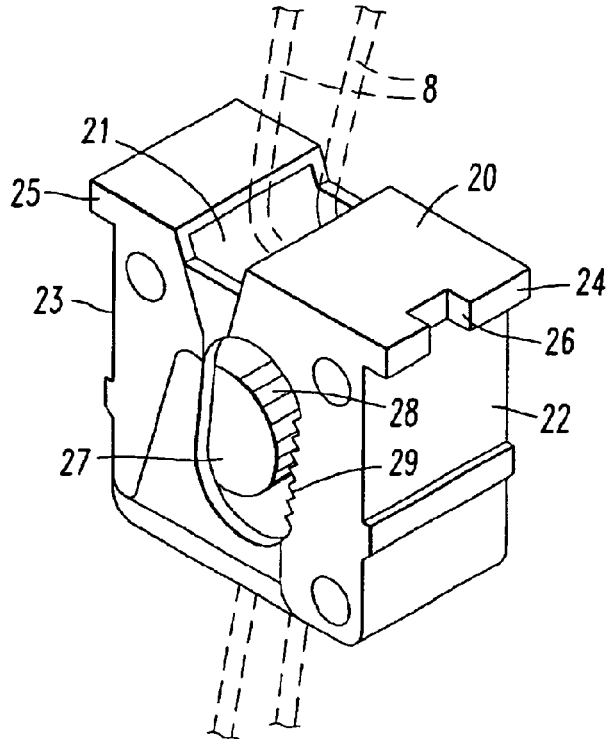
FIG. 2 is perspective view of the cord lock used in the embodiment shown in FIG. 1.

I prefer to use the cord lock shown in FIG. 2. That cord lock has a generally rectangular housing having four walls or sides that support a top 20. The top has an opening 21 through which the lift cords 8 shown in dotted line enter the cord lock. The top extends beyond the front wall 22 of the housing and beyond the rear wall 23 of the housing to create a first flange 24 extending from the front wall 22 and a second flange 25 extending from the rear wall 23. The second flange extends substantially the full width of the rear wall 23. A slot 26 is provided in the first flange 24 to receive the tab 18 on pocket 11. The second flange 25 does not have a slot. One could provide slots in that flange to save material. If a slot is made in the second flange, that slot must not be comparable in size and location to the slot 26 in the first flange 24. Consequently, the cord lock, when viewed from the top, has only one line of symmetry, which is parallel to and equidistant from the side walls that extend between the front wall 22 and the rear wall 23. By having not more than one line of symmetry, the cord lock can only be inserted one way into the pocket 11. Although the flanges 24 and 25 are flush with the top of the housing they could be positioned lower on the front and rear walls. A lock mechanism within the cord lock housing utilizes a roller 27 having teeth 28. The chamber containing the roller is wider at the bottom than near the top 20. The teeth engage a serrated surface or stair step 29 on one side of the cord lock. This surface is angled such that as the roller moves up, the gap between the roller and the inside surface of the cord lock gets smaller until the cords are squeezed and locked in place. When an operator pulls the cords through the cord lock that causes roller 24 to move down opening the gap between the roller and the inside surface of the cord lock allowing the cords to easily pass. Cord locks with similar roller lock mechanisms are well known in the art. Because the pocket orients the cord lock at an angle the lift cords 8 will normally rest against the roller 24 and pull the roller upward if the operator lets go of the cords. This orientation thus creates an anti-crash feature preventing the window covering material from rapidly falling and crashing onto the window sill when an operator releases the lift cords. The cord lock shown in the drawings is a simple three piece design. The cord lock works in both the right hand and left hand orientation. The flanges 24 and 25 keep the cord lock in the pocket yet allow easy removal. The provision of a slot 22 in the first flange requires that the lock be inserted in the correct orientation when placed into the pocket.

Figure 3:
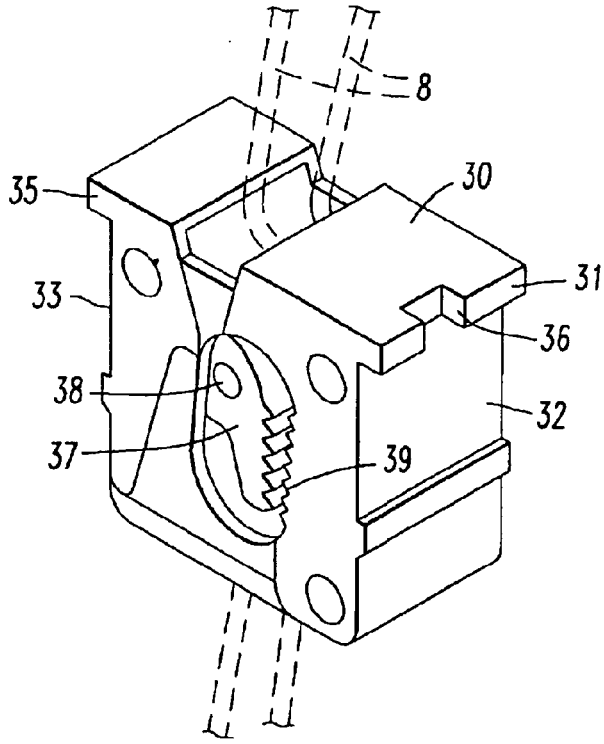
FIG. 3 is a perspective view similar to FIG. 2 of the second preferred embodiment of the cord lock.

A second embodiment of the cord lock 30 shown in FIG. 3 is nearly identical to the cord lock 14 shown in FIG. 2, but utilizes a dog leg type lock mechanism. The housing for this cord lock 34 has a front wall 32 and rear wall 33 generally parallel to the front wall. A first flange 31 extends from the front wall and a second flange 35 extends from the rear wall. A slot 36 is provided in the first flange 31 to receive tab 18 on pocket 11. A dog leg 37 is positioned on pin 38. When the lift cords attempt to move upward through the cord lock, dog leg 37 will pinch the lift cords against a wall 39 it is preferably serrated to prevent movement. Similar dog leg type locking mechanisms are well-known in the art.

Both embodiments of the cord lock can be made from plastic. I prefer to use an acetal plastic such as that sold under the trademark CELCON. On could also use other polycarbonates.

Although I have shown certain present preferred embodiments of my headrail it should be distinctly understood that the invention is not limited thereto, but may be variously embodied within the scope of the following claims.

I claim:

1. A cord lock comprising:

a housing having a front side, a rear side parallel to the front side, a left side having a length and extending between the front side and the rear side, a right side parallel to the left side and extending between the front side and the rear side, a top having an opening through which lift cords may pass, the top attached to the front side and the rear side and having a length greater than the length of the left side, the top positioned to extend beyond the front side, thereby forming a first flange, and to extend beyond the rear side, thereby forming a second flange, the first flange having a slot, wherein when the cord lock is viewed from the top, the top has not more than one line of symmetry, and a bottom having an opening through which lift cords may pass; and a cord lock mechanism within the housing.

2. The cord lock of claim 1 wherein the cord locking mechanism comprises a dog leg.

3. The cord lock of claim 1 wherein the cord locking mechanism comprises a toothed roller.

4. The cord lock of claim 3 also comprising a stair step attached to at least one side of the housing and positioned to receive the toothed roller.

5. The cord lock of claim 1 wherein the housing and flanges are plastic.

6. The cord lock of claim 1 wherein the housing is rectangular.

7. A headrail and cord lock combination comprising:

a elongated body sized and configured to hold a window covering and permit passage of lift cords from the window covering, through the headrail to a location outside the headrail;

a pocket within the headrail, the pocket having an open top, a front side having a top edge and a tab, a rear side parallel to the front side; and a cord lock removably positioned within the pocket, the cord lock comprised of:

i. a housing having a front side, a rear side parallel to the front side, a left side having a length and extending between the front side and the rear side, a right side parallel to the left side and extending between the front side and the rear side, a top having an opening through which lift cords may pass, the top attached to the front side and the rear side and having a length greater than the length of the left side, the top positioned to extend beyond the front side, thereby forming a first flange, and to extend beyond the rear side, thereby forming a second flange, the first flange having a slot, wherein when the cord lock is viewed from the top, the top has not more than one line of symmetry, and a bottom having an opening through which lift cords may pass;

ii. a cord locking mechanism within the housing;

iii. the first flange resting on the top edge of the front side of the pocket so that the tab on the front side of the pocket is within the slot; and iv. the second flange resting on the top edge of the rear side of the pocket.

8. The headrail and cord lock combination of claim 7 wherein the cord locking mechanism comprises a dog leg.

9. The headrail and cord lock combination of claim 7 wherein the cord locking mechanism comprises a toothed roller.

10. The headrail and cord lock combination of claim 9 also comprising a stair step attached to at least one side of the housing and positioned to receive the toothed roller.

11. The headrail and cord lock combination of claim 7 wherein the housing and flanges are plastic.

12. The headrail and cord lock combination of claim 7 wherein the housing and pocket are rectangular.

13. The headrail and cord lock combination of claim 9 also comprising a stair step attached to at least one side of the housing and positioned to receive the toothed roller.

14. The headrail and cord lock combination of claim 13 wherein the cord locking mechanism comprises a toothed roller.

15. The headrail and cord lock combination of claim 13 wherein the cord locking mechanism comprises a dog leg.

16. A headrail and cord lock combination comprising:

an elongated body sized and configured to hold a window covering and permit passage of lift cords from the window covering, through the headrail to a location outside the headrail;

a pocket within the headrail, the pocket having an open top, and configured to receive a cord lock when the cord lock is oriented in only one selected orientation relative to the pocket, and front side having a top edge, a rear side parallel to the front side; and a cord lock removably positioned within the pocket, the cord lock comprised of:

i. a housing having a front side, a rear side parallel to the front side, a top having an opening through which lift cords may pass, a bottom having an opening through which lift cords may pass; a first flange attached to the front side of the housing adjacent the top, the first flange resting on the top edge of the front side of the pocket; and a second flange adjacent the top, the second flange attached to the rear side of the housing and resting on the top edge, wherein the housing is configured to fit into the pocket only when the cord lock is in the one selected orientation;

ii. a cord locking mechanism within the housings; and iii. a tab on the pocket which mates with a slot in the housing of the cord lock, when the cord lock is positioned within the pocket.

* * * * *